US005945911A

United States Patent [19]

Healy et al.

[11] Patent Number: 5,945,911

[45] Date of Patent: Aug. 31, 1999

[54] FOOTWEAR WITH MULTILEVEL ACTIVITY METER

[75] Inventors: John A. Healy, Madbury, N.H.; Noshirwan K. Medora, South Attleboro; Stuart B. Brown, Needham, both of Mass.

[73] Assignee: Converse Inc., North Reading, Mass.

[21] Appl. No.: 09/042,220

[22] Filed: Mar. 13, 1998

[51] Int. Cl.[6] ..... G08B 21/00

[52] U.S. Cl. ..... 340/573.1; 36/137; 340/323 R; 340/693.5; 362/103; 362/276; 377/24.2; 482/8

[58] Field of Search ..... 340/573.1, 323 R, 340/693.5; 362/103, 276; 36/137; 377/24.2; 482/8

[56] References Cited

U.S. PATENT DOCUMENTS

| | | | |
|---|---|---|---|
| D. 285,142 | 8/1986 | McArthur | D2/309 |
| 4,158,922 | 6/1979 | Danna, III | 36/137 |
| 4,285,041 | 8/1981 | Smith | 482/3 |
| 4,309,599 | 1/1982 | Myers | 377/5 |
| 4,371,945 | 2/1983 | Karr et al. | 364/561 |
| 4,402,147 | 9/1983 | Wu | 36/136 |
| 4,466,204 | 8/1984 | Wu | 36/132 |
| 4,510,704 | 4/1985 | Johnson | 36/136 |
| 4,571,680 | 2/1986 | Wu | 364/410 |
| 4,578,769 | 3/1986 | Frederick | 364/565 |
| 4,649,552 | 3/1987 | Yukawa | 377/24 |
| 4,651,446 | 3/1987 | Yukawa et al. | 36/132 |
| 4,703,445 | 10/1987 | Dassler | 364/561 |
| 4,736,312 | 4/1988 | Dassler et al. | 364/561 |
| 4,763,287 | 8/1988 | Gerhaeuser et al. | 364/561 |
| 4,771,394 | 9/1988 | Cavanagh | 364/561 |
| 4,792,665 | 12/1988 | Ruhlemann | 235/105 |
| 4,814,661 | 3/1989 | Ratzlaff et al. | 310/328 |
| 4,848,009 | 7/1989 | Rodgers | 36/137 |
| 4,876,500 | 10/1989 | Wu | 324/663 |
| 4,891,797 | 1/1990 | Woodfalks | 368/10 |
| 4,956,628 | 9/1990 | Fulong | 340/323 R |
| 5,033,013 | 7/1991 | Kato et al. | 364/561 |
| 5,052,131 | 10/1991 | Rondini | 36/137 |
| 5,125,647 | 6/1992 | Smith | 482/8 |
| 5,164,967 | 11/1992 | Endo et al. | 377/24.2 |
| 5,188,447 | 2/1993 | Chiang et al. | 362/103 |
| 5,269,081 | 12/1993 | Gray | 36/136 |
| 5,285,586 | 2/1994 | Goldston et al. | 36/137 |
| 5,303,131 | 4/1994 | Wu | 362/103 |
| 5,303,485 | 4/1994 | Goldston et al. | 36/137 |
| 5,323,650 | 6/1994 | Fullen et al. | 73/172 |
| 5,343,445 | 8/1994 | Cherdak | 368/10 |
| 5,357,696 | 10/1994 | Gray et al. | 36/136 |
| 5,371,662 | 12/1994 | Shen-Ko | 362/276 |
| 5,373,651 | 12/1994 | Wood | 36/114 |
| 5,381,615 | 1/1995 | MacMillan | 36/137 |

(List continued on next page.)

OTHER PUBLICATIONS

LM3909 LED Flasher/Oscillator, *National Semiconductor,* Feb., 1995.

1.3V IC Flasher, Oscillator, Trigger or Alarm, *National Semiconductor Application Note 154,* Dec. 1975.

*Primary Examiner*—Glen Swann

*Attorney, Agent, or Firm*—Howell & Haferkamp, L.C.

[57] ABSTRACT

A shoe has an activity level meter that displays, in a highly noticeable fashion, such as by lighting bright LEDs, the highest level of activity reached by a wearer of the shoe. In one embodiment, the display is a three-element LED display in which zero to three LEDs flash briefly, but brightly each time the weight of the wearer is fully pressed against the inner sole of the shoe during a period of activity. A period of time after the activity ends, the LEDs light again for a longer period of time to indicate the highest level of activity reached during the activity period.

26 Claims, 2 Drawing Sheets

U.S. PATENT DOCUMENTS

| | | | |
|---|---|---|---|
| 5,394,312 | 2/1995 | Bland | 362/103 |
| 5,396,720 | 3/1995 | Hwang et al. | 36/137 |
| 5,408,764 | 4/1995 | Wut | 36/137 |
| 5,408,873 | 4/1995 | Schmidt et al. | 73/862.625 |
| 5,437,289 | 8/1995 | Liverance et al. | 128/779 |
| 5,438,488 | 8/1995 | Dion | 362/103 |
| 5,452,269 | 9/1995 | Cherdak | 368/10 |
| 5,456,032 | 10/1995 | Matsumoto et al. | 40/636 |
| 5,457,900 | 10/1995 | Roy | 36/137 |
| 5,471,405 | 11/1995 | Marsh | 364/556 |
| 5,477,435 | 12/1995 | Rapisarda et al. | 362/189 |
| 5,483,759 | 1/1996 | Silverman | 36/137 |
| 5,490,338 | 2/1996 | Hwang et al. | 36/137 |
| 5,500,635 | 3/1996 | Mott | 340/323 R |
| 5,502,903 | 4/1996 | Barker | 362/103 |
| 5,577,828 | 11/1996 | Nadel et al. | 362/103 |
| 5,599,088 | 2/1997 | Chien | 362/103 |
| 5,604,999 | 2/1997 | Barker | 36/137 |
| 5,611,621 | 3/1997 | Chien | 362/84 |
| 5,650,716 | 7/1997 | Kim | 323/282 |

FOOTWEAR WITH MULTILEVEL ACTIVITY METER

BACKGROUND OF THE INVENTION

1. Field of the Invention

This invention relates generally to footwear, and more specifically to a shoe having an indicator responsive to the activity of the person wearing the shoe.

2. Description of Related Art

U.S. Pat. No. 5,500,635 to Mott discloses a shoe having a sole in which a piezoelectric impact sensor, which may comprise polyvinylidene fluoride, is electrically connected to a circuit that contains a battery pack molded into a heel of a sole-and-heel structure. The circuit energizes a light emitting diode (LED). The LED is visible from the rear of the shoe or from some point along the circumference of the sole. In a second embodiment, a shoe is provided with numerous LEDs, one or more impact sensors, and a circuit to process information to turn on the light emitting devices so as to display a bar graph. The LEDs are positioned to be visible to the wearer while walking or running, but may be positioned at remote locations of the sole, heel, or upper of the shoe. The circuit in the second embodiment can process signals from the piezoelectronic impact sensor to light various LEDs to indicate the magnitude of impacts suffered by the shoe. By energizing from one to five LEDs, a bar graph display of impact pressure can be seen on the toe portion of the upper of the shoe. The LEDs can be different colors, or an LCD display may be substituted. Optical fiber bundles may be used to create a variety of multi-colored effects.

U.S. Pat. No. 5,611,621 to Chen discloses electroluminescent (EL) light strips sewn or glued to the side of a sports shoe. The EL light strips can be put together for a rainbow effect.

U.S. Pat. No. 5,452,269 to Cherdak discloses an athletic shoe having a timing system, an activation switch, a messaging display, and a battery. The timing device circuitry measures a time period in which the shoe is off the ground and in the air, and may include custom logic circuits to achieve timer and timing operation. The activation switch in the sole of the shoe may be a simple contact or pressure switch. The messaging display displays a time-based message, but can display other information, such as speed, distance traveled, activity time or duration, foot pressure, or cadence. The display may be a liquid crystal display (LCD) or a LED display that shows alphabetic, numeric, or graphic characters.

SUMMARY OF THE INVENTION

While prior art references show that footwear having lights, impact sensors, and displays are known, it would still be advantageous in a sports shoe to provide a simplified display showing the activity of the wearer. More particularly, it would be advantageous to provide a shoe that can employ a simple switch as an activity sensor and that can display an activity indication both during the activity itself and after the activity ends. It would additionally be advantageous for the circuitry to use a minimum amount of power from an internal battery to avoid the necessity of replacing the battery during the life of the shoe, but also to provide an attractive, bright display. It would be most advantageous to provide a shoe briefly displaying activity indications during the activity itself, and automatically providing a longer duration display of the highest level of activity achieved during a period immediately prior to the cessation of the activity. This latter feature would allow the wearer to concentrate on performing the activity first, and then after stopping, look down at the shoe to see what level of activity was reached. The wearer, however, to the extent that he or she desires or is able to do so, can still confirm that the shoe is accumulating information by observing the shorter indications of activity that occur during the activity itself.

Therefore, it is an object of the invention to provide a shoe that displays a simplified indication of multiple levels of activity.

It is a further object of the invention to provide a shoe that can employ a simple switch as an activity sensor and that can display an activity indication both during the activity itself and after the activity ends.

It is yet another object of the invention to provide a shoe with an activity meter that provides an attractive, bright display without the necessity of replacing the battery during the life of the shoe.

It is still another object of the invention to provide a shoe that briefly displays indications of a level of activity during the activity itself, while automatically providing a longer display of the highest level of activity reached during a period immediately following the cessation of the activity.

There is thus provided, in accordance with one aspect of the invention, a shoe having an electrical transducer responsive to activity of a person wearing the shoe to produce occurrences of an activity signal; a processor responsive to a frequency of occurrences of the activity signal from the electrical transducer to generate a coded indicator signal indicative of a measure of activity of the person wearing the shoe; and an indicator on the shoe responsive to the coded indicator signal to provide, to the person wearing the shoe, a perceptible indication of the measure of the activity of the person for a period of time after the activity of the person has ended. In one embodiment of the invention, the perceptible indication is given by a multi-element LED display visible to the wearer of the shoe. The LED may be in a form such as a three-element display or three separate LEDs, with increasing numbers of LEDs lit to indicate increased activity. According to another aspect of the invention, the LEDs flash for a brief period after each footstrike, and, after a period in which no footstrike occur, the last (or highest) activity level reached is displayed for an extended period of time. In accordance with another aspect of the invention, when no further activity occurs, the LEDs displaying the last (or highest) activity level are extinguished one at a time, in sequence.

These and other objects of the invention will become apparent to one skilled in the art upon study of the figures and the detailed description appearing below.

BRIEF DESCRIPTION OF THE DRAWINGS

Corresponding reference characters indicate corresponding parts throughout the several view of the drawings.

DESCRIPTION OF THE PREFERRED EMBODIMENTS

Figure 1:
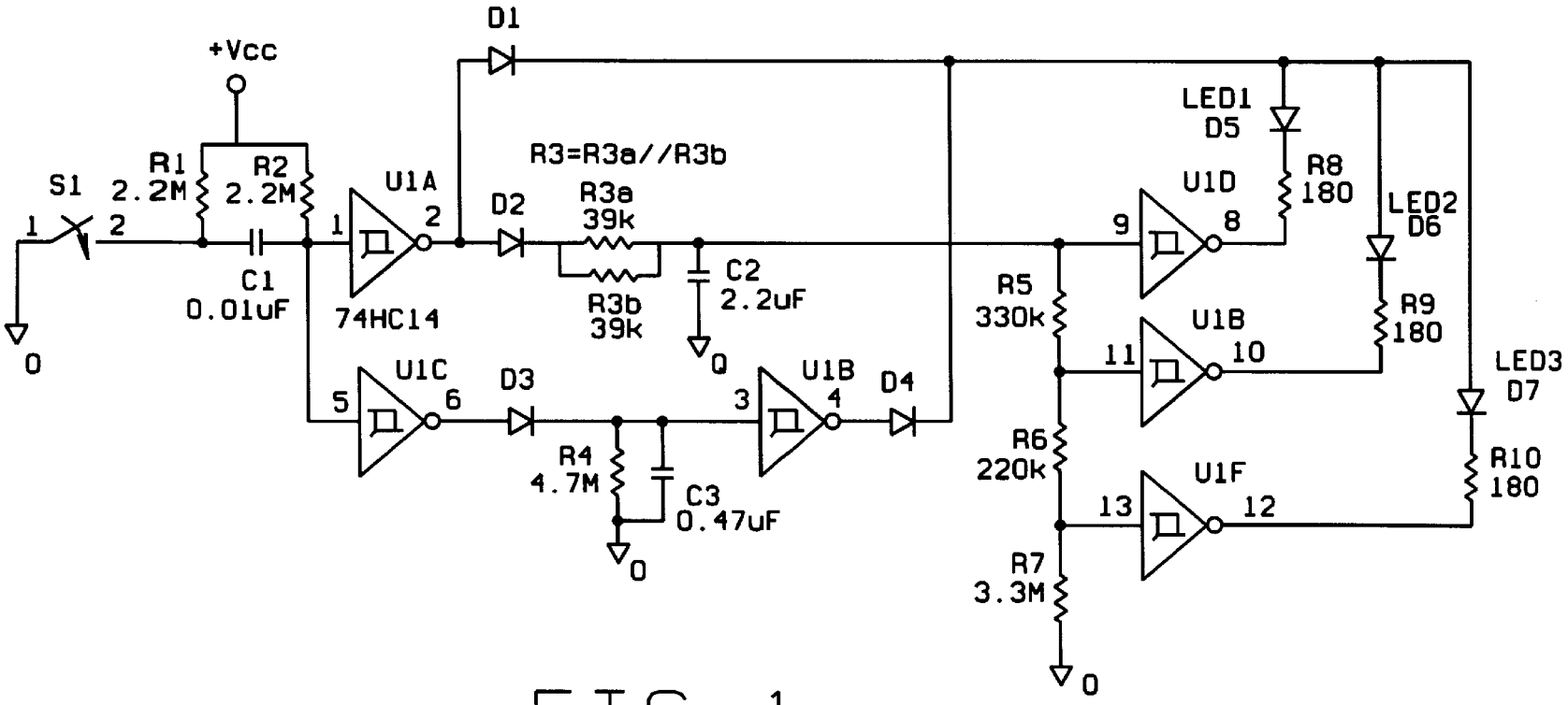
FIG. 1 is a schematic diagram of an embodiment of an activity measuring and indicating circuit of a shoe of the present invention.

One embodiment of an activity measuring and indicating circuit suitable for use in the inventive shoe is shown schematically in FIG. 1. The values of the components in the schematic of FIG. 1 are listed in Table I. (In Table I, k=1000, M=1,000,000, and $\mu=1\times10^{-6}$.) Although it is desirable to use the circuit of FIG. 1 (or its equivalent, such as in a custom ASIC [Application Specific Integrated Circuit]) and the values of the components listed in Table I, one skilled in the art would understand the function of the circuitry and be able to make various modifications of the circuitry and substitutions of components upon reading the description of the circuitry that follows. For example, criteria for selecting resistors and capacitors are discussed in more detail in another portion of this specification. Other diodes types may be substituted for D1–D4, however, 1N4148 diodes were chosen because of their very low cost. The use of a hex inverter IC helps to keep the parts count low. Other hex inverter ICs (integrated circuits) could be substituted for the 74HC14, but this particular component was chosen because of its extremely low standby power consumption, very low cost, and operation at voltages as low as 2 volts. Other logic types could be used, although any substituted inverter should be one with hysteresis. It is also recognized that circuitry different from that illustrated in FIG. 1 but that essentially duplicates all or most of the functions described herein may be substituted for the circuit of FIG. 1.

TABLE I

LIST OF COMPONENTS FOR THE CIRCUIT OF FIG. 1

| Component | Value |
|---|---|
| All resistors | 1/8 watt, 5% |
| R1, R2 | 2.2 MΩ |
| R3A | 39 kΩ |
| R3B | 39 kΩ |
| R4 | 4.7 MΩ |
| R5 | 330 kΩ |
| R6 | 220 kΩ |
| R7 | 3.3 MΩ |
| R8, R9, R10 | 180 Ω |
| C1 | 0.01 μF |
| C2 | 2.2 μF |
| C3 | 0.47 μF |
| D1, D2, D3, D4 | 1N4148 |
| D5, D6, D7 | Red LEDs |
| U1 | Schmitt Trigger Inverter (74HO14) |
| $V_{cc}$ | Lithium Battery DL2430 |

Switch S1 is a switch having open and closed positions, and which is normally open. Switch S1 is closed by application of foot pressure by the wearer of the shoe, and thus acts as an electrical transducer that responds to the activity of a person wearing the shoe. Preferably, switch S1 is a pressure sensitive switch that is not responsive to activity, such as movement of the shoe, while the shoe is not being worn. Preferably, the switch is located and configured to be responsive to footstrikes rather than mere motion of the shoe. If switch S1 is placed in the heel of a shoe, for example, it is preferable for the weight of the wearer to close the switch and keep it closed upon contact of the heel of the shoe with the ground. However, the switch should open when the weight of the wearer is removed from the switch, such as when the heel leaves the ground.

Initially, both terminals of capacitor C1 are at $+V_{cc}$ potential, because of the connection of both terminals to the $V_{cc}$ supply through resistors R1 and R2, respectively. Thus, the input signal to inverters U1A and U1C are high (at or near $V_{cc}$), causing their outputs to be low (at or near zero volts). In this condition, the outputs of U1A and U1B (which are sections of a hex inverter 74HC14, which provides six inverters U1A–U1F per discrete package) are low. Therefore, diodes D1, D2, and D3 are non-conducting, and the voltage on the positive terminal of C2 is zero because of its connection to ground through the series-connected resistors R5, R6, and R7. Similarly, the voltage across C3 is zero, because of the connection of R4 across C3. The output of U1B is therefore high, but the outputs of U1D, U1E, and U1F are also high. Because LED1, LED2, and LED3 are each connected between outputs in a high state, there is no voltage across them (or at least, not enough voltage to cause significant conduction), and therefore, they are not energized.

When the wearer engages in an activity such as walking, running, or jumping, the pressure of the wearer's foot against the inside of the shoe causes switch S1 to be repeatedly opened and closed. Upon closure of switch S1, the high-impedance inputs of U1A and U1C go to a low value momentarily, until either switch S1 opens or the charge on C1 is restored through resistor R2, with time constant R2C1. The time constant R2C1 is selected to be short enough so that it is less than the time between impacts of the shoe against the ground while a person wearing the shoe is running very rapidly. Time constants less than about 50 ms are satisfactory for this purpose, and in this embodiment, R2C1 has been chosen to be 22 mS. The actual value selected is not particularly critical (as long as it meets the criteria defined by shoe impacts), although selection of a different time constant will influence the values of other components in the circuit, as will be explained below. When the input of U1A goes low momentarily, its output will go high momentarily, causing diode D2 to conduct and capacitor C2 to charge through resistor R3 (which, in the circuit of FIG. 1, comprises the parallel combination of two resistors R3A and R3B) and diode D2 with a time constant determined by the product of the capacitance of C2 and R3 and the series combination of R5, R6, and R7. Because the series combination of R5, R6, and R7 is large compared to R3, the time constant for charging C2 is essentially R3C2, or about 86 mS in this circuit embodiment. Because the period of time that the output of U1A is high is so short for each closure of S1, several closures of S1 are required before C2 is charged to a high enough voltage to drive the output of U1D low. In the meantime, the charge on C2 is slowly bled off through the series combination of R5, R6, and R7, so unless the repeated closures of S1 occur relatively frequently, there will not be enough charge accumulated on C2 to drive the output of U1D (or U1E or U1F) to a low state.

It will be observed that, when S1 is opened, such as when pressure on S1 is relieved by the shoe leaving the ground, capacitor C1 will again reach $V_{cc}$ potential at both terminals, with a time constant equal to (R1+R2)C1. Input over voltage and under voltage protection is inherent in the 74HC14 IC, which has internal input protection diodes to clamp the input voltage to be within one diode drop of $V_{cc}$ or ground.

Let us assume now that C2 has acquired a sufficient voltage to drive the output of (at least) U1D low. For LED1 to conduct and to energize, its anode must be at a higher voltage with respect to its cathode. Thus, either diode D1 or diode D4, which act logically together as an "OR" gate, must also be conducting. Diode D1 conducts briefly (for a time period set by capacitors C1 and R2) at each closure of switch S1, while capacitor C2 is charged. If capacitor C2 is sufficiently charged to cause the output of U1D to go low when switch S1 closes, LED1 will flash briefly for an amount of time when switch S1 is closed to produce an activity signal because of the pulsed high level at the output of U1A.

(Isolating diodes D1 and D4 ensure that a high logic level at either the output of U1A or U1B can allow LED1 and the other LEDs to light.) Thus, if the wearer is jumping up and down frequently enough, walking briskly, or running, enough charge can build up on capacitor C2 to allow (at least) LED1 to flash. It will thus be apparent that inverter U1A, diode D2, resistor R3 and capacitor C2 comprise, because of the finite length of the activity signal that is generated with each switch S1 closure, a processor that is responsive to the frequency of occurrences of the activity signal from electrical transducer S1. The signal generated by this processor is a voltage produced on C2 that corresponds to a measure of activity of the person wearing the shoe.

With each closure of switch S1, capacitor C3 is charged through diode D3 (which isolates C3 from output of U1C when the output is low). Capacitor C3 is sufficiently charged with each such closure (in contrast to C2, which, because it is in series with resistor R3, requires a number of closures to become fully charged) to cause the output of U1B to go to a low logic state. This low logic state persists until capacitor C3 is sufficiently discharged by leakage through resistor R4, at which time the output of U1B returns to a high state. It takes less time for U1B to return to a high state than to discharge C2 because of the respective discharge time constants of C2 and C3. Therefore, when the output of U1B goes high, if there is a sufficient residual charge remaining on C2, (at least) LED1 will light and remain lit until C2 is sufficiently discharged to cause it to be extinguished. It is thus evident that C2 and R3 comprise an integrator responsive to the signal generated by the closings of switch S1.

Resistors R5, R6, and R7 form a divider network. If the charge lost from C2 between the closings of switch S1 is less than the amount added as a result of the pulsed output of U1A upon each switch S1 closure, the voltage on C2 will gradually increase until it becomes high enough to cause the output of U1D to go low. If the closures are frequent enough, the charge will continue to increase until the voltage on C2 is sufficient to cause the output of U1E to go low. If the closures are still more frequent, the voltage on C2 will eventually increase until the output of U1F goes low. Thus, voltage divider R5, R6 and R7 set thresholds for activity levels, because LED1, LED2, and LED3 will light up (either in response to a pulsed switch closure or upon the output of U1B returning to a high state after a sufficiently long gap occurs between closures, such as when the activity of the wearer has ended), depending upon there having been a sufficient number and frequency of switch S1 closures. Thus, the LED1, LED2, and LED3 comprise an indicator having separately energizable elements that activate at different threshold levels of activity in response to a coded indicator signal. The coded indicator signal in this circuit is coded by the voltage present on C2 and is decoded by the voltage divider comprising R5, R6, and R7 and the respective inputs to U1D, U1E, and U1F to provide a perceptible indication of the measure of activity of a person wearing the shoe having the activity meter circuit. In this embodiment, a visual indication is provided, although other types of indications, such as audible indications, could be provided as an alternative, or in addition to, the visual indication. The indication is given a period of time after the activity has ended, because the indicator is enabled only after capacitor C3 has sufficiently discharged, which occurs sometime after the activity ceases.

It is desirable to make the flashes of LED1, LED2, and LED3 that can occur with each switch closure relatively brief. It is also desirable to light the LEDs for a more extended period only after a brief but identifiable lapse of activity, and to limit the extended period to a few seconds. These criteria can be met by proper selection of the circuit time constants associated with capacitors C1, C2, and C3. It is further desirable to use high input impedance gates throughout the circuit as well as the largest practical resistance values. However, resistors R8, R9, and R10 should conduct enough current when in circuit with their respective LEDs to allow the LEDs to light up to a desired brightness level consistent with a reasonable level of power consumption.

For example, the component values listed in Table I produce brief, but quite visible blinks lasting a small fraction of a second with each switch closure when C2 has been sufficiently charged. Also, a delay is provided of about 2 to 3 seconds after a gap in activity before the LEDs light for the extended time period. With the listed components, there is also an approximately 6 second time period after the extended time period begins before all of the LEDs are extinguished, although this period can vary somewhat depending upon the final voltage reached by C2. The specified components also set activity levels such that, if switch S1 is depressed about once every two seconds, in 6 to 8 seconds capacitor C2 is charged sufficiently to light LED1; if S1 is depressed about once per second, LED1 and LED2 will be lit; and if S1 is depressed once about every half second, LED1, LED2, and LED3 will all be lit. (These correspond to frequencies of 0.5, 1.0, and 1.9 depressions per second, respectively.) Also, the various charging and discharging time constants are set by the specified components so that the extended-time LED display (i.e., the display that occurs after a gap in activity) represents a display of the highest activity level that occurred before the gap in switch S1 closures occurred.

When an activity indicator is added to a shoe as an active decoration or novelty, the need for absolute accuracy of its operation may be offset by aesthetic considerations. Therefore, high precision measurement of activity is not required, allowing inexpensive components with relatively broad tolerances to be used. Aesthetic considerations concerning the lighting of LED1, LED2, and LED3 and battery life may often be important factors in the selection of relative charging and discharging time constants for capacitors C1, C2, and C3.

Considerations that go into the proper selection of component values, and particularly time constant values, may be summarized as follows: First, a time constant is selected for the combination of R2C1. This time constant is not particularly critical, but must be somewhat less than the minimum time expected between switch closures of S1. It is also desirable that the time constant be long enough to allow a visible flash of the LEDs during an activity period. As indicated above, satisfactory results are obtained with a time constant of about 22 ms. Next, a value of C1 is selected that is consistent with physical size limitations, inasmuch as the circuit is intended to be embedded in a shoe. The value of R2 may then be determined based on the value of C1 selected and the time constant chosen. The value of R2 (or equivalently, C1) may require some adjustment to account for the hysteresis of the inverter gates U1A and U1C, although the combined effects of the hysteresis and the exponential charging of capacitor C1 tend to produce pulses at the outputs of U1A and U1C that have a length close to the actual time constant R2C1 that is chosen. These combined effects, together with the general noncriticality of the activity measurement, tend to reduce the need for adjustment of component values.

To reduce inventory costs, it is desirable for R1 to have the same resistance as R2. However, R1 should be large enough so that, if a person is standing and thus applying sufficient pressure to close switch S1, the flow of current through R1 and switch S1 does not result in a significant drain on the battery. If it does, R1 should be increased. In such a case, consideration may also be given to increasing R2 and decreasing C1 accordingly.

Capacitor C2 is charged through resistor R3 and diode D2. The current through D2 when C2 is charging in the circuit of FIG. 1 results in a 0.65 v drop across D2, but is reduced to about 0.2–0.3 v because of the reduced current that flows through D2 as C2 reaches a maximum charge in this circuit (about 2.7–2.8 v). The voltage across C2 as the activity level circuit is activated determines the input voltage applied to U1D. Resistors R5, R6, and R7 are selected based upon the voltage across C2 at the desired activity level thresholds, and the threshold input levels of the corresponding inverters. The time constant R3C2 is selected to be several times larger than R2C1 (in this case, about 86 ms), so that with increased rapidity of switch closures of S1, increasing charge is gradually accumulated on C2. If switch S1 is activated at a constant rate, the charge on capacitor C2 is periodically replenished through the series combination of diode D2 and capacitor R3, but is also continuously drained through resistors R5, R6 and R7. Eventually, the discharge rate between switch closures reaches an equilibrium with the charging rate supplied by the pulses that occur with each switch closures. Thus, the charge on capacitor C2 reaches a steady-state condition with an equilibrium value of voltage (that varies relatively slightly between switch closures).

Resistors R5, R6, and R7 are selected so that their total value allows the input to U1D to rise to its threshold value (i.e., the voltage at which the output goes low) at the desired minimum activity level, which in the circuit of FIG. 1 is about 0.5 switch closures per second. The allocation of the total resistance between R5, R6, and R7 is made so that U1E and U1F reach their threshold values when C2 reaches its equilibrium at 1.0, and 1.9 closures per second in the circuit of FIG. 1. Thus, LED1, LED2, and LED3 illuminate at footstrike rates of 0.5, 1.0, and 1.9 footstrikes per second. Of course, different or additional activity levels may be selected as desired.

Time constant R4C3 is related to the time before a final indication of activity is given after the activity stops, and should be about one to three seconds. When the switch closures stop, capacitor C2 is discharged, and thus, if inverters U1D, U1E, and U1F had no hysteresis, the maximum activity level reached might not be properly indicated if the time constant R4C3 were too large. However, because of the hysteresis of inverters U1D, U1E, and U1F, the voltage at the input of these inverters has to drop below the threshold voltage that was reached at their input before the output goes high again. Because of this fact, the time constant R4C3 can be on the order of seconds, and is, in fact, about 2.2 seconds in the circuit of FIG. 1. (The hysteresis of inverter U1B also has to be taken into consideration in determining how long a delay occurs before the final activity display is activated.) The circuit is configured so that, after U1B and D4 go high, the anodes of LED1, LED2, and LED3 remain high, until another closure of switch S1. However, the series resistance of resistors R5, R6, and R7 is selected to discharge C2 so that a low enough voltage across C2 is reached to extinguish LEDs a few seconds after the final activity display, thus conserving battery power.

Many modifications of the circuit are possible within the scope of the invention. For example, the number and colors of the LEDs may be varied, or, with appropriate substitution of circuitry, other visible indicators may be used, such as EL panels or liquid crystal displays. (EL panels may be especially desirable in some applications because of the wide variety of available colors and ease of producing decorative patterns. However, EL displays require more complex driving circuitry.) Various types of switches S1 may be used, although membrane switches are preferred for their durability, ease of manufacture, sensitivity, and unobtrusiveness to the wearer when disposed in (for example) the heel of a shoe. Piezoelectric generators may be used instead of switches with appropriate modifications to the circuitry, and may advantageously serve as a source of power as well, possibly eliminating the need for a separate battery to power the circuitry.

Much of the circuitry may be placed in a single ASIC (Application Specific Integrated Circuit) with ease, possibly substituting standard gates for the isolation diodes as dictated by convenience. This ASIC could incorporate the 74HC14 Hex Schmitt Trigger Inverter as well as 5 resistors and 4 diodes, if the circuitry of FIG. 1 were to be used. The diodes can be replaced with logic gates, if that results in further cost reductions. Three of the outputs require 180 ohm, 1/16 W resistors to duplicate the circuit of FIG. 1 (the value and wattage rating may vary depending upon the LED current required to light the LEDs to the desired brightness, the type of LEDs used, and the supply voltage). The remaining resistors carry very little current and thus can have a very low power rating (the smallest possible power rating consistent with current manufacturing techniques is sufficient). The 74HC14 has a maximum threshold voltage of 2.2 V, while operating at 3 Vdc. Preferably, in an ASIC, the threshold should be reduced to 1.7 V, with a resultant hysteresis voltage of 0.5 V. With these specifications, the ASIC will have a very low operating current (preferably less than 0.25 mA) when the input to the inverters is between 0–3 Vdc, and the supply voltage is 3.0 Vdc. Quiescent power is preferably similar to or less than that of the discrete implementation (which itself has been measured in a number of test units as being less than 0.1 microamperes at 25° C.), and should not exceed 2 microamperes at room temperature (25° C.) for extended battery life. (The 74HC14 used in the discrete implementation described herein draws 3.0 microamperes maximum quiescent supply current at 5.5 volts at 85° C.) It is preferred that the ASIC operate reliably over a voltage range of 2–5 Vdc, and that it have a low-cost surface-mount package to reduce manufacturing costs and the amount of space required for embedding the circuitry in a shoe.

The reduced power consumption of the circuit of FIG. 1 results in a large number of operating cycles being obtained from one 200 or 300 mAh lithium cell. It has been demonstrated that, using a DL2430, 300 mAh lithium cell, the circuit will operate for over 88,000 cycles, each cycle being 5 seconds of fast running and an "off" period of 25 seconds. It has further been demonstrated that, using a DL2032, 200 mAh lithium cell, the circuit will operate for over 60,000 cycles, each cycle being 5 second of fast running and an "off" period of 25 seconds. A higher light intensity is possible with the same average current if the circuit is modified to provide high current pulse operation of the LED.

For LEDs, a wider viewing angle generally implies a lower luminous intensity. It is desirable to select LEDs that maximize both viewing angle and luminosity to maximize visibility of the activity display. High output "Superbright" red LEDs such as model no. AND120CR available from Purdy Electronics Corp., Sunnyvale, Calif. are desirable for this application. These LEDs are available with a forward voltage of 2.0 V at 10 mA current, with a specified operating temperature of −10° C. to 60° C., in at least four different varieties having luminous intensities and viewing angles at 20 mA as shown in Table II. Of course, other types and colors of LEDs may be substituted, depending upon the effect desired. Low cost LEDs that are available from many manufacturers may be used when manufacturing costs are a concern. Red indicator LEDs are generally preferred for their visibility, but LEDs of other colors may be used to provide desired lighting effects.

TABLE II

LED LUMINOUS INTENSITY AND VIEWING ANGLE AT 20 mA

| Luminous Intensity, mcd | Viewing Angle, Deg. |
|---|---|
| 100 | 19 |
| 750 | 30 |
| 680 | 50 |
| 400 | 60 |

Switch S1 can be any small microswitch, tilt switch, inertia switch, or any other form of switch that provides contact closures the frequency of which can be made to vary in accordance with an activity of the wearer. Most preferably, however, S1 is a subminiature, printed circuit board mountable, tactile pushbutton switch of the single pole, single throw (SPST), normally open, momentary variety, having the specifications indicated in Table III.

TABLE III

SWITCH S1 SPECIFICATIONS

| Specification | Value |
|---|---|
| Initial Contact Resistance | 200 milliohm maximum |
| Contact Rating | 20–50 mA @ 12 Vdc |
| Operating Cycles | $1 \times 10^6$–$2 \times 10^6$ mech. and elect. |
| Operating Temp. | −10° C. to 60° C. |
| Maximum Dimensions | 0.5 × 0.5 × 0.18 inches |

It should be understood that, while it is desirable that the above specifications for the LEDs and the switch be met, those skilled in the art would be able to make such substitutions for the specified components as may be deemed necessary or desirable for availability, manufacturing, aesthetic, or other reasons.

Figure 2:
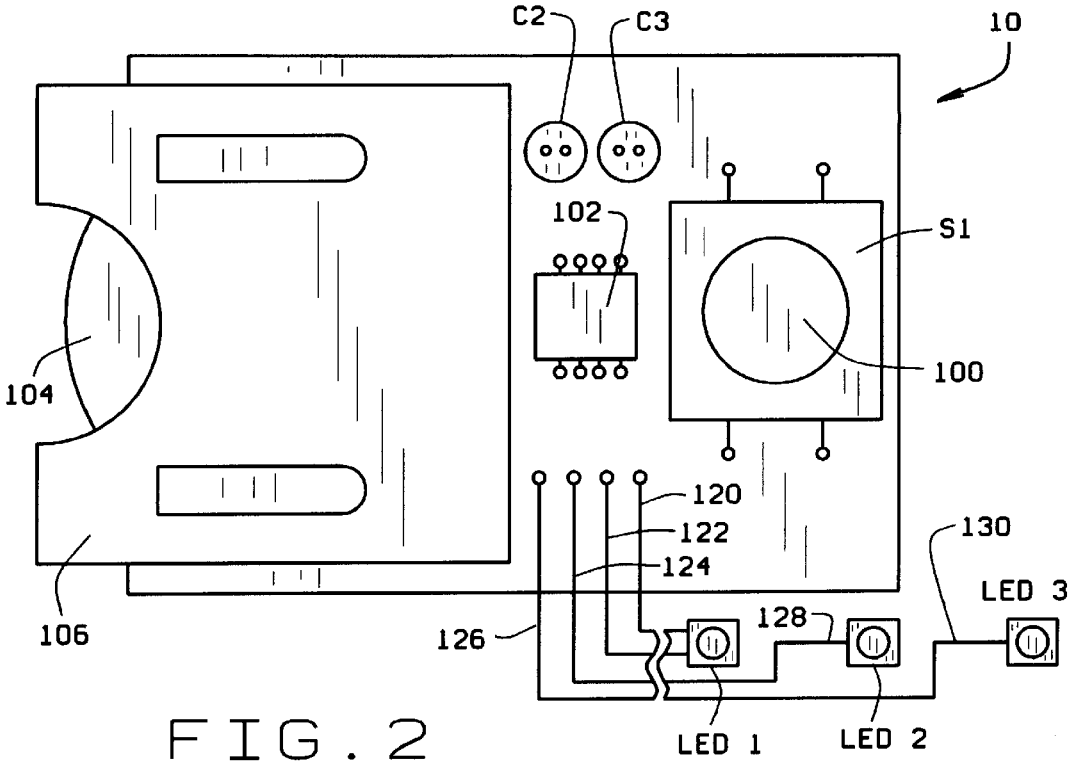
FIG. 2 is a top plan view of a circuit board including the activity measuring and indicating circuit of FIG. 1.

FIG. 2 shows a circuit board 10 on which is mounted an ASIC 102 containing many of the functional components of FIG. 1. The tactile switch S1 is preferably mounted at one end of circuit board S1. Lithium battery 104 is mounted in a battery holder 106 to supply the needed voltage $V_{cc}$ to ASIC 102 and in a manner that does not interfere with the operation of tactile switch S1. Capacitors C2 and C3 may also be mounted on circuit board 10 in a manner that does not interfere with operation of switch S1. LED1, LED2, and LED3 are connected to the circuit board by means of external wiring, which may be run either in the sole of a shoe, or in its sidewalls. The LEDs themselves are mounted on the shoe in any externally visible location, preferably one in which they are easily visible to the wearer of the shoe.

Figure 3:
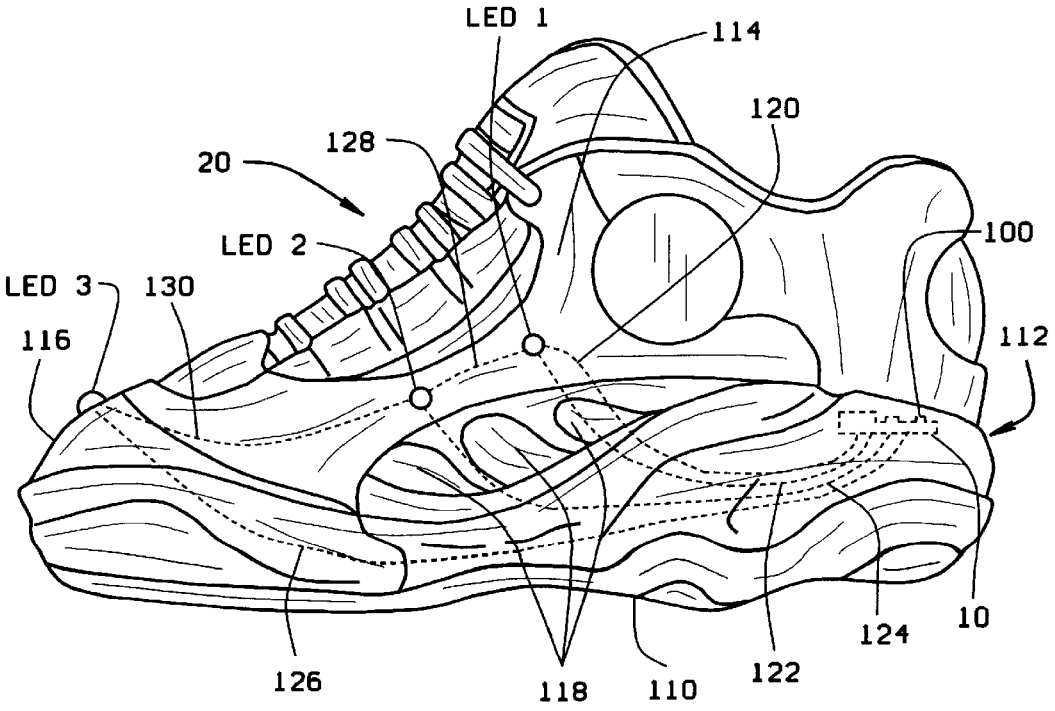
FIG. 3 is a side-elevational view of a shoe of the present invention, the shoe including the circuit of FIGS. 1 and 2.

FIG. 3 shows one preferred way in which the circuit board of FIG. 2 may be embedded in a typical athletic shoe so that it becomes a shoe 20 with a built-in activity meter in accordance with the invention. Circuit board 10 is preferably mounted inside the heel portion 112 of the sole 110 of shoe 20, and more preferably mounted inside the heel portion of the midsole. Mounting may be accomplished by any suitable method, such as by molding. This location of the circuit board 10 is preferred when button 100 of switch S1 is located on the circuit board as shown in FIG. 2, because with this configuration, the heel of a wearer's foot will activate switch S1 when the wearer is stepping, walking, jumping, or running. Any other mounting combination may be used for switch S1 in shoe 20 may be used that causes the circuit to be activated by these activities. Preferably, in the configuration shown in FIG. 3, button 100 is covered by a sock liner (not shown in FIG. 3) such as is normally inserted into an athletic shoe, to provide comfort for the wearer. Because athletic shoes, and especially children's athletic shoes are often replaced as they are outgrown or worn out, it is not required that circuit board 10 be accessible after installation, as the expected battery life is compatible with the anticipated useful life of the shoe. However, the circuit board 10, or portions thereof, may be made accessible for battery replacement, such as by removal of the sock liner, and by providing access in the top of heel portion 112 through which the battery powering circuit board 10 may be reached. By way of example, the battery (which may be physically attached to circuit board 10, or optionally contained in a battery holder or compartment separate from, but electrically connected to circuit board 10) may reside in an upwardly opening recess or cavity positioned under the sock liner.

Wires 120, 122, 124, 126, 128, and 130 from circuit board 10 may be routed (and molded) in sole portion 110 of shoe 20 and inside the upper 114, 116 of shoe 20 to supply power to LED1, LED2, and LED3. These LEDs are shown in FIG. 3 as being mounted in locations on the upper 114 and toe portion 116 of upper 114 so that they are visible to the wearer. Any other suitable location may be used for the LEDs or other indicators; for example, panels 118 are shown in which could be mounted three electroluminescent displays which could be used in lieu of or in addition to the LEDs. Alternately, the LEDs could be mounted in a translucent diffusion panel or cover, such as a molded clear plastic to which a frosted surface has been applied. Such diffusion panels or other suitable means may be used to increase the angles from which the LEDs are clearly visible. The output of the circuit board could be applied to indicator displays other than simple lighting devices such as LEDs. For example, the outputs could be applied to another circuit that converts and displays the outputs into an alphanumeric format. For example, the additional circuitry could provide a simple "0", "1", "2", "3" display for activity levels on an LCD display, for example, where "0" might be assigned as an indicator of no activity, or activity insufficient to reach the first detected level. More complex conversions are also possible, particularly if the activity sensing circuitry is modified to allow it to indicate more than three levels of activity.

As discussed above, those skilled in the art would be able to make many modifications of the specific embodiments of the invention discussed herein without departing from the spirit of the invention. For this reason, the scope of the invention should not be considered as being limited to the examples presented in detail herein, but should be determined by reference to the claims below and the full range of equivalents permitted under applicable law.

What is claimed is:

1. A shoe comprising:

a footwear assembly including at least a sole and at least an upper secured to the sole;

an electrical transducer in the footwear assembly responsive to activity of a person wearing the shoe to produce occurrences of an activity signal;

a processor in the footwear assembly responsive to a frequency of occurrences of the activity signal from the electrical transducer to generate a coded indicator signal indicative of a measure of activity of the person wearing the shoe; and an indicator responsive to the coded indicator signal and operatively connected to the footwear assembly in a location to provide a perceptible indication of the measure of the activity of the person for a first period of time after the activity of the person has ended, the indicator also being responsive to the coded indicator signal to provide a perceptible indication of the measure of the activity of the person for a second period of time after an occurrence of the activity signal.

2. The shoe of claim 1 wherein the second period of time is shorter than the first period of time.

3. The shoe of claim 2, wherein the indicator is responsive to the coded indicator signal to provide a perceptible indication of a highest level of activity reached by the person during a period of activity, prior to the ending of the period of activity.

4. The shoe of claim 1 wherein the indicator is responsive to the coded indicator signal to provide a perceptible indication of a highest level of activity reached by the person during a period of activity, prior to the ending of the period of activity.

5. The shoe of claim 4 wherein the indicator is a visual display providing a visual indication of the measure of the activity.

6. The shoe of claim 5 wherein the visual display comprises a plurality of separately energizable elements that activate at different threshold levels of the measure of activity.

7. The shoe of claim 6 wherein the indicator comprises a plurality of electroluminescent panels.

8. The shoe of claim 7 wherein the indicator comprises a plurality of light-emitting elements.

9. The shoe of claim 8 wherein the light-emitting elements are solid-state light-emitting diodes.

10. The shoe of claim 6 wherein the electrical transducer comprises a normally open switch having open and closed positions.

11. The shoe of claim 4 wherein the processor comprises an integrator responsive to the signal from the electrical transducer.

12. The shoe of claim 4 wherein the processor comprises a first timing gate having a control input and control output, the control input being electrically connected to the transducer and the control output being electrically connected to the visual indicator, the timing gate being configured to reset after each occurrence of an activity signal and to provide a path for current to flow through the indicator after a selected period from a time at which the timing gate was last reset.

13. The shoe of claim 12 wherein the coded activity signal is a voltage, the indicator is a visual indicator, and the integrator is configured to provide a voltage that decreases while the timing gate is providing a path for current to flow through the indicator, to ensure that the visual indicator is extinguished after a period of time.

14. The shoe of claim 13 wherein the path provided by the timing gate for current to flow through the indicator is a first path, and further comprising a second, alternate path coupled to the indicator and configured to provide a path for current to flow through the indicator for a selected time upon occurrence of an activity signal.

15. The shoe of claim 14 wherein both the first path and the second path are configured to be nonconductive for an interval between an end of the predetermined time upon occurrence of an activity signal and a beginning of the selected time from a time at which the timing gate was last reset.

16. The shoe of claim 15 wherein the electrical transducer and processor are embedded in a heel portion of the shoe.

17. A shoe configured to be worn by a wearer in a manner so that the shoe repeatedly strikes a surface, such as a running or walking surface, as the wearer walks, runs, or jumps while wearing the shoe, each occurrence of the shoe striking the surface while the wearer is wearing the shoe constituting a footstrike, and the walking, running, or jumping of the wearer constituting an activity of the wearer, the shoe comprising:

a footwear assembly including at least a sole and at least an upper secured to the sole, the upper being adapted to cover at least part of a foot of a wearer wearing the shoe; and a circuit secured to the footwear assembly, the circuit including an electrical transducer, a processor electrically coupled to the transducer, and an indicator electrically coupled to the processor, the electrical transducer and processor being adapted to generate a footstrike signal representative of a frequency of the footstrikes, the indicator being responsive to the footstrike signal to provide a perceptible indication of a level of intensity of the activity of the wearer, the circuit having a quiescent supply current of not more than 2 microamperes at 25° C.

18. The shoe of claim 17, wherein the circuit has a quiescent supply current of less than 0.1 microamperes at 25° C.

19. The shoe of claim 17, wherein the circuit comprises a visual indicator configured to provide a visual indication of a level of intensity of the activity of the wearer.

20. The shoe of claim 19, wherein the visual indicator comprises a lighted indicator configured to briefly flash in response to a footstrike signal of at least a predetermined frequency, and further configured to provide a longer, lighted indication of a level of activity reached by the wearer after an interval from a cessation of the activity in the footstrike signal;

and the circuit further comprises a gate to ensure that the longer, lighted indication is extinguished after a period of time.

21. An activity meter suitable for inclusion in an article of clothing such as footwear, comprising:

(a) a switch configured for repeatedly closing in response to a person's activity, the closures occurring at a rate indicative of a level of an activity to be measured;

(b) a charge accumulating circuit coupled to the switch and configured to accumulate charge in response to closures of the switch;

(c) a discharging circuit coupled to the charge accumulating circuit for discharge thereof and having an output configured to produce, in cooperation with the charge accumulating circuit, a voltage output indicative of the rate of closures of the switch in response to a constant rate of closures of the switch;

(d) an indicating device having a first terminal and a second terminal;

(e) at least one inverter having an input responsive to the output of the discharging circuit and an output coupled to a first terminal of the indicating device; and (f) a time-delay circuit having an input coupled to the switch and an output coupled to a second terminal of the indicating device and configured to reset with each closing of the switch, the inverter and the time-delay circuit being configured to activate the indicating device when a voltage at the output of the discharging circuit exceeds a predetermined value after a time determined by the time-delay circuit has expired with a switch closing, until the charge accumulating circuit has discharged through the discharging circuit.

22. The circuit of claim 21, wherein the inverter has hysteresis.

23. The circuit of claim 22, wherein the discharging circuit comprises a voltage divider network with a plurality of output taps, and further comprising a plurality of indicators each with first terminals and second terminals, and a plurality of inverters each having hysteresis and an input connected to a different output taps of the voltage divider network and an output connected to the first terminal of a different one of the plurality of indicators, and the time-delay circuit is coupled to the second terminal of each of the plurality of indicators, so that the activation of a different number of indicators occurs, depending upon a maximum level of activity reached.

24. The circuit of claim 23, and further comprising a pulse-generating circuit responsive to the switch closures and having an output coupled to the second terminal of each of the indicators, the pulse-generating circuit configured to briefly allow activation of a number of the indicators, depending upon a level of activity reached, with each switch closure and for a period of time less than that required for reactivation of the indicators by the time-delay circuit.

25. A shoe comprising:

a footwear assembly including at least a sole and at least an upper secured to the sole;

a circuit in the footwear assembly comprising an electrical transducer, a processor, and an indicator, wherein the electrical transducer is responsive to activity of a person wearing the shoe to produce occurrences of an activity signal, the processor is responsive to a frequency of occurrence of the activity signal indicative of a measure of activity of the person wearing the shoe; and the indicator is responsive to the coded indicator signal and operatively connected to the footwear assembly in a location to provide a perceptible indication of the measure of the activity of the person for a first period of time after the activity of the person has ended; and wherein the circuit has a quiescent supply current of not more than 2 microamperes at 25° C.

26. The shoe of claim 25, wherein the circuit has a quiescent supply current of not more than 0.1 microamperes at 25° C.

* * * * *